United States Patent [19]

Ishikawa et al.

[11] 4,356,158

[45] Oct. 26, 1982

[54] PROCESS FOR PRODUCING CARBON FIBERS

[75] Inventors: Toshikatsu Ishikawa, Tokyo; Haruo Teranishi, Machida; Akira Yokoyama, Yokohama; Tetsuo Yanagi, Yokohama; Hirofumi Harada, Yokohama, all of Japan

[73] Assignee: Nippon Carbon Co., Ltd., Tokyo, Japan

[21] Appl. No.: 315,575

[22] Filed: Oct. 27, 1981

[30] Foreign Application Priority Data

Jul. 4, 1981 [JP] Japan ..... 56-103911

[51] Int. Cl.[3] ..... D01F 9/14

[52] U.S. Cl. ..... 423/447.4; 264/29.2; 423/447.1; 423/447.6

[58] Field of Search ..... 423/447.4, 447.6, 447.1, 423/447.2; 264/29.2

[56] References Cited

U.S. PATENT DOCUMENTS

| | | | |
|---|---|---|---|
| 3,392,216 | 7/1968 | Otani et al. | 423/447.6 |
| 3,595,946 | 7/1971 | Joo et al. | 423/447.6 |
| 3,629,379 | 12/1971 | Otani et al. | 423/447.6 |
| 3,702,054 | 11/1972 | Araki et al. | 423/447.4 X |
| 3,995,014 | 11/1976 | Lewis | 423/447.4 |
| 4,115,527 | 9/1978 | Otani et al. | 423/447.4 |

FOREIGN PATENT DOCUMENTS

| | | | |
|---|---|---|---|
| 1307392 | 2/1973 | United Kingdom | 423/447.4 |

*Primary Examiner*—Edward J. Meros
*Attorney, Agent, or Firm*—Ladas & Parry

[57] ABSTRACT

A process for producing carbon fibers from various kinds of pitches wherein the calorific values of the pitches are measured and the pitches thereafter subjected to a suitable procedure for producing carbon fibers therefrom depending on their measured calorific value.

5 Claims, 1 Drawing Figure

PROCESS FOR PRODUCING CARBON FIBERS

Figure 1:
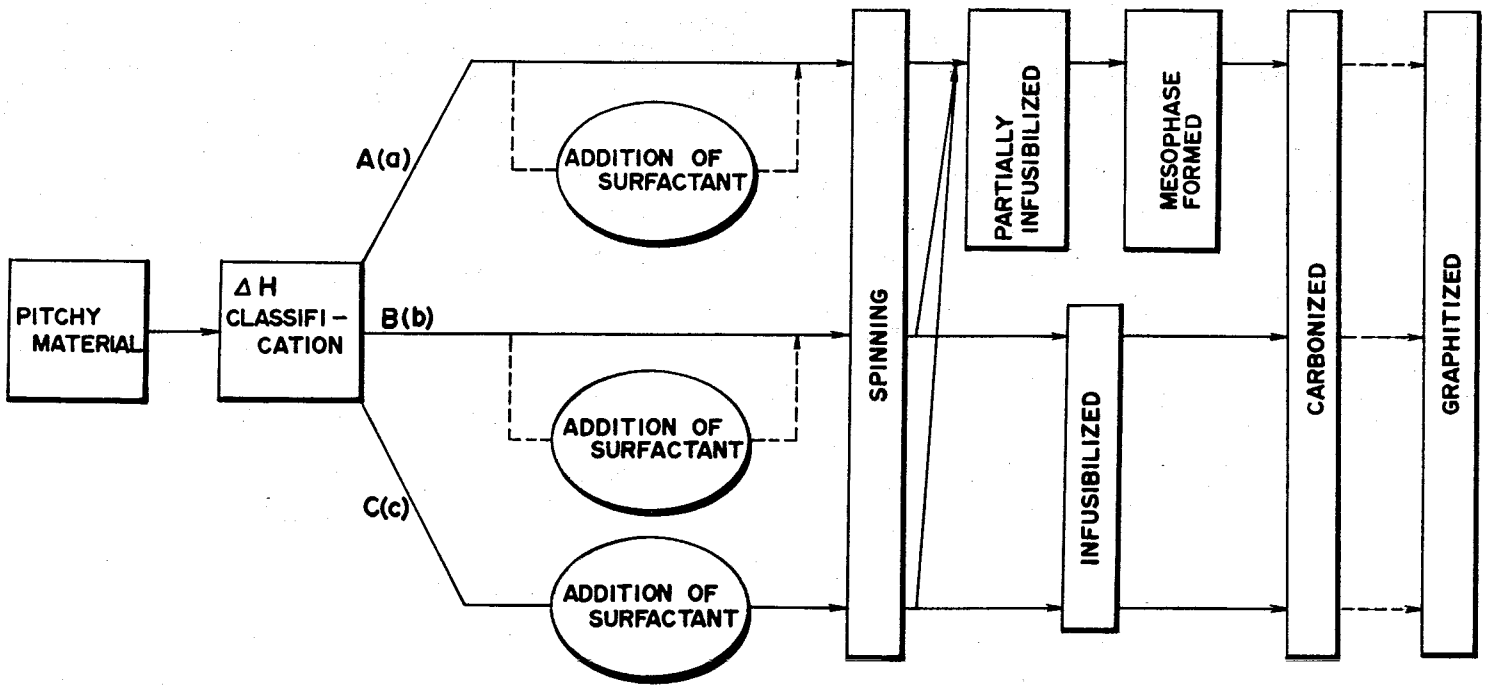

This invention relates to a process for the production of carbon fibers. More particularly, it relates to a carbon fiber-producing process which permits various kinds of pitchy materials such as coal tar pitch, petroleum pitch, natural asphalt, pitchy materials obtained by thermal depolymerization of high molecular weight compounds, and said pitchy materials in the further heat treated state, to be used as the starting material in the production of carbon fibers therefrom without conventional specific preadjustment or pretreatment by selecting a suitable procedure for producing carbon fibers depending on the calorific value (ΔH) of a particular kind of pitchy material.

In the conventional production of carbon fibers from various pitchy materials (pitchy materials being hereinafter referred to as "pitches" for brevity), there have been proposed methods for preadjusting or pretreating the pitches as the starting material. The conventional methods so proposed are exemplified by a method comprising pre-adjusting the pitches to form a pitch having a carbon content of 91–95%, a method comprising preadjusting the pitches to form a pitch having a high molecular weight (such as a molecular weight of 300 or more) and a method comprising pre-adjusting the pitches to form a pitch having a limited softening point (°C.) and a limited meso phase content.

These conventional methods comprising such a preadjusting step are useful as a means for avoiding melt adhesion of pitch fibers to one another in an infusibilizing (making infusible) step which is one of the steps of a process for producing carbon fibers from pitches. However, not only they are troublesome and complicated in pre-adjustment and selection of pitches to obtain suitable pitches for use therein as the starting material, but also it is difficult to select and obtain pitches which are effectively useful throughout all of the spinning, insolubilizing and carbonizing steps. In order to obtain to-be-spinned fibers having improved strength, etc., there have heretofore been no suitable ways other than strict specification of conventional starting materials or selection of insolubilizing and carbonizing conditions such as a temperature and atmosphere.

The reasons for this are as follows:

(1) The roping property or spinnability of pitches is conflicting with the infusibility thereof; in other words, the better the spinnability is, the less the infusibility is, and vice versa.

(2) Even if pitch fibers prepared from pitches having good spinnability were insolubilized, they will be fusion bonded to one another in the subsequent carbonizing step thereby to make it impossible for them to exhibit their performance as fibers.

(3) Even if pitches are specified as having a carbon content of, for example, 91–95%, the spinnability and infusibility thereof as well as the performance of carbonization products prepared therefrom will be greatly influenced depending on, for example, their chemical structure which may be a chain or cyclic structure since their structure is very chemically complicated. The same is true with pitches having a specified softening point or molecular weight.

The primary object of this invention is to provide a process for producing carbon fibers having desirable properties without preadjustment or pretreatment of pitches as the starting material.

In an attempt to achieve said object, the present inventors made intensive studies and, as the result of their studies, they noted a difference in calorific value (ΔH) between pitches and found that said object may be attained by varying a procedure for obtaining carbon fibers from a pitch depending on the calorific value (ΔH) thereof. This invention is based on said finding or discovery.

The process of this invention is as follows.

In a process for producing carbon fibers from pitchy materials, the process comprising the steps of:

(1) measuring pitches for their individual calorific values (ΔH) to classify into (a) a pitch having $\Delta H < 10$ cal/g, (b) a pitch having $\Delta H = 10$ to 150 cal/g and (c) a pitch having $\Delta H > 150$ cal/g, (2) melt spinning the pitch (a) to obtain pitch fibers, partially infusibilizing (making infusible) the thus obtained pitch fibers at ambient temperature to 280° C. in an oxidizing atmosphere to oxidize the peripheral portion of the fibers to an extent that the thickness of the resulting oxidized peripheral portion in the form of an oxide film amounts to not larger than 5% of the radius of the original pitch fibers and then heat treating the partially infusibilized pitch fibers at 360°–450° C. in an inert atmosphere to allow the pitch fiber inner portion surrounded with said oxide film to form an optically anisotropic mesophase thereby obtaining fixed fibers, melt spinning the pitch (b) to obtain pitch fibers, either infusibilizing the thus obtained pitch fibers at 220°–280° C. in an oxidizing atmosphere to obtain fixed fibers or partially infusibilizing the pitch fibers at ambient temperature to 280° C. in an oxidizing atmosphere to oxidize the peripheral portion of the fibers to an extent that the thickness of the resulting oxidized peripheral portion in the form of an oxide film amounts to not larger than 5% of the radius of the original pitch fibers and then heat treating the partially infusibilized pitch fibers at 360°–450° C. in an inert atmosphere to allow the pitch fiber inner portion surrounded with said oxide film to form an optically anisotropic mesophase, thereby obtaining fixed fibers, melting the pitch (c), adding a fluorine-containing surfactant to the melted material (c) in an amount by weight of 0.1–10% thereof and agitating the resulting mixture, melt spinning the mixture to obtain pitch fibers, either infusibilizing the thus obtained pitch fibers at 220°–280° C. in an oxidizing atmosphere to obtain fixed fibers or partially infusibilizing the pitch fibers at ambient temperature to 280° C. in an oxidizing atmosphere to oxidize the peripheral portion of the fibers to an extent that the thickness of the resulting oxidized peripheral portion in the form of an oxide film amounts to not larger than 5% of the radius of the original pitch fibers and then heat treating the partially infusibilized pitch fibers at 360°–450° C. in an inert atmosphere to allow the pitch fiber inner portion surrounded with said oxide film to form an optically anisotropic mesophase thereby obtaining the fixed fibers, and (3) heat treating the fixed fibers obtained respectively from said pitches (a), (b) and (c), at 750°–1500° C. in a non-oxidizing atmosphere to obtain carbon fibers and, if desired, further heat treating the thus heat treated fixed fibers at 2400°–3000° C. to graphitize the carbon fibers.

The calorific value, ΔH, may be determined by placing 7–13 mg of a pitch as the sample in a differential scanning calorimeter and then raising the pitch sample in temperature at a rate of 5°–15° C./min. The pitches to be used are classified on the basis of the calorific values so determined.

More specifically, in the practice of this invention, the partial infusibilization may preferably be effected by heating at a temperature-raising rate of 30°-60° C./hr to 240°-270° C. and maintaining at this temperature for 10-90 minutes, the infusibilization by heating at a temperature-raising rate of 15°-30° C./hr to 260°-280° C. and maintaining at this temperature for 30-60 minutes, the carbonization by heating at a temperature-raising rate of 50°-100° C./hr to 800°-1500° C. and maintaining at this temperature for 10-90 minutes, and the graphitization by heating at a temperature-raising rate of 100°-200° C./hr to 2000°-2500° C. and maintaining at this temperature for 10-20 minutes.

It is necessary for a pitch having a calorific value, ΔH, of higher than 150 cal/g, after being melted under heat, to be incorporated with a fluorine-containing surfactant in an amount by weight of 0.1-10% of the pitch and agitated in order to allow the pitch to have satisfactory spinnability.

Pitches (a) and (b) may also be incorporated with 0.1-10% by weight of a fluorine-containing surfactant as in the case of the pitch (c) as required; however, the use of the surfactant in larger amounts is undesirable since it deteriorates the pitch in spinnability. Among the fluorine-containing surfactants used herein, perfluoroalkylsulfonates ($C_8$) are preferred. However, depending on the softening point of pitches to be used and the amount of a mesophase portion therein, there may also be used a perfluoroalkylcarboxylate, perfluoroalkylphosphate, oligomer comprising a perfluoroalkyl group containing an oleophilic or hydrophilic group or the like.

In this invention, the pitch (a) is melt spinned to form pitch fibers which are partially infusibilized and heat treated to take a mesophase form thereby obtaining fixed fibers. On the other hand, the pitch fibers obtained from the pitches (b) and (c) are infusibilized to form fixed fibers or they are partially infusibilized and then heat treated to take a mesophase form thereby producing fixed fibers.

It is to be noted that the term "fixed fibers" used herein is intended to mean fibers which have been infusibilized or partially infusibilized to take a mesophase form prior to being carbonized.

In this invention, the infusibilization is effected at 220°-280° C. in an oxidizing atmosphere and the partial infusibilization is effected at ambient temperature to 280° C. in an oxidizing atmosphere so that the peripheral portion of the pitch fibers is oxidized to an extent that the thickness of the resulting oxidized peripheral portion (oxide film) amounts to not larger than 5% of the radius of the original pitch fibers. The heat treatment for allowing the pitch fibers to take a mesophase form is effected at 360°-450° C. in an inert atmosphere to render the fiber inner portion within the oxide film optically anisotropic. The fixed fibers so obtained are raised in temperature at a rate of 30°-300° C./hr to 750°-1500° C. at highest in an inert atmosphere to be carbonized thereby to obtain carbon fibers; if desired, the thus obtained carbon fibers may further be heated to 2400°-3000° C. to be graphitized.

The flow chart of the process of this invention is as shown in FIG. 1 in which A(a) indicates the flow for a pitch (a) having $\Delta H < 10$ cal/g, B(b) the flow for a pitch (b) having ΔH of 10 to 150 cal/g, and C(c) the flow for a pitch (c) having $\Delta H > 150$ cal/g.

This invention will be better understood by the following Examples, Comparative Examples and Reference Examples.

EXAMPLE 1

A petroleum-derived pitch having a softening point of 185° C. and ΔH of 3.7 cal/g was melted at 280° C. and melt spinned at a spinning speed of 300 m/min. through a spinneret (or nozzle) having 72 holes of 0.3 mm in diameter to obtain pitch fibers. The thus obtained pitch fibers were heat treated at 260° C. for 10 minutes in the air to oxidize the peripheral portion of the fibers to the extent that the thickness of the resulting oxidized peripheral portion (oxide film) amounted to 1% of the radius of the original fibers. The peripherally oxidized fibers were then heat treated at 420° C. for 10 hours in a helium (He) atmosphere to render optically anisotropic the fiber inner portion surrounded with the oxide film thereby obtaining fixed fibers. The fixed fibers so obtained were raised in temperature at a rate of 100° C./hr to 1000° C. to be carbonized thereby to obtain carbon fibers having a tensile strength of 142 $Kg/mm^2$ and a Young's modulus (tensile modulus) of 12.3 $t/mm^2$.

EXAMPLE 2

The pitch fibers as obtained in Example 1 were heat treated at 30° C. for 10 minutes in a chlorine ($Cl_2$) atmosphere to oxidize the peripheral portion of the fibers to the extent that the thickness of the resulting oxidized peripheral portion (oxide film) amounted to 5% of the radius of the original pitch fibers. The pitch fibers so heat treated were then further heat treated at 450° C. for 5 hours in a helium (He) atmosphere to allow the fiber inner portion surrounded with the oxide film to take an optically anisotropic mesophase form thereby obtaining fixed fibers. The fixed fibers so obtained were carbonized under the same conditions as in Example 1 to obtain carbon fibers having a tensile strength of 121 $Kg/mm^2$ and a Young's modulus of 10.7 $t/mm^2$.

COMPARATIVE EXAMPLE 1

The pitch fibers as obtained in Example 1 were heat treated at 260° C. for 60 minutes in the air to oxidize the peripheral portion of the fibers to the extent that the thickness of the resulting oxidized peripheral portion (oxide film) amounted to 8% of the radius of the original fibers. The pitch fibers so treated were further treated to obtain fixed fibers which were then treated to obtain carbon fibers under the same conditions as in Example 1. The thus obtained carbon fibers had a tensile strength of 60 $Kg/mm^2$ and a Young's modulus of 3.3 $t/mm^2$.

COMPARATIVE EXAMPLE 2

The pitch fibers as obtained in Example 1 were raised in temperature at a rate of 30° C./hr in the air to 260° C. and maintained at this temperature for 60 minutes to be infusibilized thereby to obtain fixed fibers which were then carbonized under the same conditions as in Example 1. However, the pitch fibers were somewhat melt bonded to one another in the infusibilizing step and approximately entirely bonded to one another in the carbonizing step.

EXAMPLES 3-5, COMPARATIVE EXAMPLE 3 AND REFERENCE EXAMPLES 1-3

A coal-derived pitch having a softening point of 158° C. and ΔH of 1.8 cal/g was melted at 250° C. and incorporated with a fluorine-containing surfactant in each of the wt. ratios as shown in Table 1, the surfactant so incorporated being perfluoroalkylcarboxylate ($C_8$) (produced under the trademark of Megafac F-110 by Dai Nippon Ink Chemical Industry Co., Ltd.), after which the resulting mixture was spinned at a take-up speed of about 300 m/min. through a nozzle having 72 holes, each 0.3 mm in diameter, to obtain pitch fibers. The frequency of breakage (or tear) of fibers in the spinning step is indicated in Table 1.

In addition, a part of the pitch fibers thus obtained were partially infusibilized and made to take a mesophase form to obtain fixed fibers as indicated in Table 1, after which the thus obtained fixed fibers were heated at a temperature-raising rate of 100° C./hr to 1000° C. in an inert atmosphere of nitrogen ($N_2$) to be carbonized thereby to obtain carbon fibers having the properties as shown in Table 1.

TABLE 1

| | Ratio between amount of fluorine-containing surfactant added and amount of pitch (wt. %) | Frequency of breakage of fibers (times/min.) | Ratio of oxide film thickness to fiber radius (%) | Conditions for infusibilization | Conditions for allowing to take mesophase form | Properties of carbon fibers: Tensile strength (Kg/mm²) | Properties of carbon fibers: Young's modulus (ton/mm²) |
|---|---|---|---|---|---|---|---|
| Ex. 3 | 0.1 | 1–1.5 | 4 | 260° C. 60 min. | 420° C. 10 hrs. | 130 | 10.2 |
| Ex. 4 | 5 | 0–1 | 4 | 260° C. 60 min. | 430° C. 6 hrs. | 130 | 11.9 |
| Ex. 5 | 10 | 0–1 | 0.08 | 260° C. 10 min. | 430° C. 6 hrs. | 141 | 13.1 |
| Com. Ex. 3 | 5 | 0–1 | 15 | 260° C. 120 min. | 450° C. 5 hrs. | 60 | 3.2 |
| Ref. Ex. 1 | 0.05 | 2–4 | | | | | |
| Ref. Ex. 2 | 0 | 3–5 | | | | | |
| Ref. Ex. 3 | 12 | 3–5 | | | | | |

Note:
Ex.: Example
Com. Ex.: Comparative Example
Ref. Ex.: Reference Example

EXAMPLE 6

A petroleum-derived pitch having a softening point of 200° C. and ΔH of 10.6 cal/g was melted at 290° C. and melt spinned at a spinning speed of about 300 m/min. through a spinneret (or nozzle) having 72 holes, each 0.3 mm in diameter, to obtain pitch fibers. The thus obtained pitch fibers was heated at a temperature-raising rate of 30° C./hr to 260° C. in the air, maintained at this temperature for one hour to be insolubilized, heated at a temperature-raising rate of 80° C./hr to 1000° C. and then maintained at this temperature for 30 minutes to obtain carbon fibers. The thus obtained carbon fibers had a tensile strength of 80 Kg/mm² and a Young's modulus of 4.0 t/mm².

EXAMPLE 7

The procedure of Example 6 was followed except that a petroleum-derived pitch having a softening point of 198° C. and ΔH of 10.2 cal/g was melted, thereby to obtain carbon fibers. These carbon fibers had a tensile strength of 83 Kg/mm² and a Young's modulus of 4.5 t/mm².

EXAMPLE 8

A polyvinyl chloride pitch having a softening point of 182° C. and ΔH of 21.1 cal/g (the polyvinyl chloride pitch having been obtained by pyrolyzing PVC at 400° C. for one hour in a nitrogen atmosphere) was melted at 280° C. and then treated under the same conditions as in Example 6 thereby to obtain carbon fibers. These carbon fibers were supple without melt bonding to one another and had a tensile strength of 80 Kg/mm² and a Young's modulus of 3.6 t/mm².

EXAMPLE 9

A polyvinyl chloride pitch having a softening point of 210° C. and ΔH of 14.5 cal/g (the pitch having been obtained by pyrolyzing PVC at 400° C. for two hours in a helium atmosphere) was melted at 290° C. and then treated under the same conditions as in Example 6 thereby to obtain carbon fibers. These fibers were supple without melt bonding to one another and had a tensile strength of 84 Kg/mm² and a Young's modulus of 3.8 t/mm².

EXAMPLE 10

A coal-derived pitch having a softening point of 246° C. and ΔH of 53.2 cal/g was melted at 330° C. and then treated under the same conditions as in Example 6 thereby to obtain carbon fibers. These fibers were supple without any melt bond therebetween and had a tensile strength of 92 Kg/mm² and a Young's modulus of 4.6 t/mm².

EXAMPLE 11

A petroleum-derived pitch having a softening point of 280° C. and ΔH of 132 cal/g was melted at 370°–385° C. and melt spinned at a spinning speed of about 250 m/min. through a nozzle having 20 holes, each 0.4 mm in diameter to obtain pitch fibers. The pitch fibers so obtained were heated at a temperature-raising rate of 30° C./hr to 280° C., maintained at this temperature for one hour to be insolubilized and then heated at a temperature-raising rate of 70° C./hr to 1000° C. in a nitrogen stream thereby to obtain carbon fibers. The carbon fibers so obtained had a tensile strength of 75 Kg/mm² and a Young's modulus of 3.8 t/mm².

COMPARATIVE EXAMPLES 4–5

A coal-derived pitch having a softening point of 310° C. and ΔH of 174.0 cal/g and a polyvinyl chloride pitch having a softening point of 325° C. and ΔH of 270.0 cal/g were each attempted to be melt spinned. However, none of the pitches was uniformly melted and allowed pitch fibers to be continuously obtained therefrom.

EXAMPLE 12

A coal-derived pitch having a softening point of 240° C. and ΔH of 50.3 cal/g was melted at 330° C. and melt spinned at a spinning speed of 300 m/min. through a nozzle having 20 holes, each 0.3 mm in diameter, to obtain pitch fibers having a 20-μ diameter each.

The pitch fibers so obtained were heated at a temperature-raising rate of 30° C./hr to 260° C. to be partially infusibilized. The thus obtained partially infusibilized fibers were heated to 430° C. for 5 hours in a nitrogen gas to take a mesophase form.

The fibers so made crystalline were found to have a 0.1μ thick optically isotropic layer along the periphery thereof and an optically anisotropic inner portion (mesophase portion) surrounded with said optically isotropic layer by observing the cross section of the fibers with a polarizing microscope.

The thus obtained fibers having the oxide surface layer and mesophase inner portion were heated at a temperature-raising rate of 50° C./hr to 1000° C. in a nitrogen gas to obtain carbon fibers. These carbon fibers had a tensile strength of 150 Kg/mm$^2$ and a Young's modulus of 13.8 ton/mm$^2$.

EXAMPLE 13

The procedure of Example 12 was followed except that the 20-μ diameter pitch fibers were heated at a temperature-raising rate of 15° C./hr, to obtain carbon fibers. The carbon fibers so obtained had a tensile strength of 147 Kg/mm$^2$ and a Young's modulus of 13.5 ton/mm$^2$. In these carbon fibers, the oxide layer which surrounded the mesophase inner portion and was optically isotropic, was 0.2μ thick.

EXAMPLE 14 AND COMPARATIVE EXAMPLES 6–8

Using the pitch fibers having a 20-μ diameter as obtained in Example 12 and varying the conditions for infusibilization, there were obtained various partially infusibilized fibers which varied in degree of oxidation. The fibers so varied in degree of oxidation were heated to take a mesophase form and then carbonized under the same conditions as in Example 12 to obtain four kinds of carbon fibers which were then measured for properties. The results as well as those of Examples 12 and 13 are shown in Table 2.

TABLE 2

| Example and Comparative Example | Partially infusibilizing conditions and Properties: Partial infusibilization: Temp.-raising rate (°C./hr) | Temp. for partial infusibilization (°C.) | Time for partial infusibilization (min.) | Ratio of thickness of optically isotropic layer to radius of fiber after mesophase formation thereof (%) | Properties of carbon fibers: Tensile strength (Kg/mm$^2$) | Young's modulus (ton/mm$^2$) |
|---|---|---|---|---|---|---|
| Example 12 | 30 | 260 | 30 | 1.0 | 150 | 13.8 |
| Example 13 | 15 | 260 | 30 | 2.0 | 147 | 13.5 |
| Example 14 | 30 | 270 | 30 | 4.8 | 144 | 13.2 |
| Comparative Example 6 | 30 | 285 | 30 | 8.0 | 102 | 5.6 |
| Comparative Example 7 | 30 | 290 | 30 | 100 | 95 | 5.1 |
| Comparative Example 8 | 30 | 300 | 30 | 100 | 92 | 4.7 |

EXAMPLE 15

A petroleum-derived pitch having a softening point of 235° C. and ΔH of 46.2 cal/g was melted at 420° C. and then melt spinned at a spinning speed of 300 m/min. to obtain pitch fibers, each 22μ in diameter.

The thus obtained pitch fibers were heated at a temperature-raising rate of 15° C./hr to 270° C. in the air to partially infusibilize the same.

The fibers so partially infusibilized were maintained at 360° C. for 16 hours to take a mesophase form, after which the observation of the cross section of the fibers so made crystalline with a polarizing microscope showed that the fibers had a 0.2μ thick ring-shaped optically isotropic layer as the surface layer therein and an optically anisotropic inner portion (mesophase inner portion) surrounded with said ring-shaped layer.

The partially infusibilized fibers were heated at a temperature-raising rate of 100° C./hr to 1000° C. in a nitrogen gas thereby to obtain carbon fibers which were found to have a tensile strength of 145 Kg/mm$^2$ and a Young's modulus of 13.0 ton/mm$^2$.

EXAMPLE 16

The same pitch as used in Example 15 was melted at 360° C. in an argon atmosphere, incorporated with perfluoroalkylsulfonate ($C_8$) (which is a fluorine-containing surfactant produced under the trademark of Megafac F-110 by Dai Nippon Ink Chemical Industry Co., Ltd.) in an amount by weight of 1% of the pitch, agitated under 500 r.p.m. for 30 minutes and then melt spinned at a spinning speed of 200 m/min. through a suitable spinneret at the same temperature as mentioned above to obtain pitch fibers which had a smooth surface and a diameter of 12μ on the average. The spinning at said spinning rate was satisfactorily effected substantially without the fibers being torn.

The pitch fibers so obtained were heat treated at 240° C. for 90 minutes in the air to oxidize the peripheral portion of the fibers to the extent that the thickness of the resulting oxidized peripheral portion (oxide film) amounted to 2% of the radius of the original fibers, after which the fibers so heat treated were again heat treated at 430° C. in a nitrogen ($N_2$) atmosphere to allow the inner portion thereof surrounded with said oxide film to take a mesophase form and then further heated at a temperature-raising rate of 100° C./hr to 2500° C. in a nitrogen atmosphere to obtain carbon fibers which were found to have a tensile strength of 182 Kg/mm$^2$ and a Young's modulus of 28.0 t/mm$^2$.

COMPARATIVE EXAMPLE 9

The pitch fibers as obtained in Example 16 were heat treated at 270° C. for 20 minutes in the air to form an oxide film of the fibers as the surface layer therein, the oxide film having a thickness corresponding to 7% of the radius of the original fibers. The fibers so heat treated were further heat treated under the same conditions as in Example 16 to obtain carbon fibers. These carbon fibers had a tensile strength of 92 Kg/mm$^2$ and a Young's modulus of 13.9 t/mm$^2$.

REFERENCE EXAMPLES 4–10

In each of these Reference Examples, a petroleum-derived pitch having a softening point of 240° C. and ΔH of 50.3 cal/g were melted at 330° C., incorporated with a fluorine-containing surfactant (perfluoroalkyl, hydrophilic and oleophilic groups-containing oligomer produced under the trademark of Megafac 177 by Dai Nippon Ink Chemical Industry Co., Ltd.) in the amount as indicated in Table 3 and then melt spinned at a take-up speed of about 300 m/min. through a nozzle having 72 holes, each 0.3 mm in diameter to obtain pitch fibers. The frequency of breakage (or tear) of the fibers in the melt spinning step in each case is shown in Table 3.

TABLE 3

| | Ratio between amount of fluorine-containing surfactant added and amount of pitch (wt. %) | Frequency of breakage of fibers in spinning step (times/min.) |
|---|---|---|
| Ref. Ex. 4 | 0 | 4–6 |
| Ref. Ex. 5 | 0.05 | 4–6 |
| Ref. Ex. 6 | 0.1 | 2–3 |
| Ref. Ex. 7 | 1 | 1–2 |
| Ref. Ex. 8 | 5 | 1–2 |
| Ref. Ex. 9 | 10 | 2–3 |
| Ref. Ex. 10 | 15 | 5–8 |

Note:
Ref. Ex.: Reference Example

EXAMPLES 17–18 AND COMPARATIVE EXAMPLES 10–11

In each of these Examples and Comparative Examples, the coal-derived pitch having a softening point of 310° C. and ΔH of 174.0 cal/g as used in Comparative Example 4 were melted at 390° C., incorporated with a fluorine-containing surfactant (perfluoroalkylcarboxylate ($C_8$) produced under the trademark of Megafac F-110 by Dai Nippon Ink Chemical Industry Co., Ltd.) in the amount as indicated in Table 4 and then melt spinned at a spinning speed of 80 m/min. through a nozzle having 72 holes, each 0.3 mm in diameter to obtain pitch fibers. The frequency of breakage (or tear) of the fibers is shown in Table 4.

The pitch fibers so incorporated with the surfactant were infusibilized by heating at 280° C. for 60 minutes in the air and then carbonized at temperatures up to 1000° C. thereby to obtain carbon fibers. The properties of the thus obtained carbon fibers are indicated in Table 4.

TABLE 4

| | Ratio between amount of fluorine-containing surfactant added and amount of pitch (wt. %) | Frequency of breakage of fibers in spinning step (times/min.) | Properties of carbon fibers: Tensile strength (Kg/mm$^2$) | Properties of carbon fibers: Young's modulus (t/mm$^2$) |
|---|---|---|---|---|
| Ex. 17 | 0.1 | 4–5 | 70 | 7.0 |
| Ex. 18 | 10 | 2–3 | 68 | 6.5 |
| Com. Ex. 10 | 0.05 | Impossible to spin | — | — |
| Com. Ex. 11 | 12.0 | 6–7 | 55 | 5 |

Note
Ex.: Example
Com. Ex.: Comparative Example

EXAMPLE 19

The pitch fibers as obtained in Example 17 were heat treated to 260° C. for 10 minutes in the air to form an oxide film of the fibers as the surface layer therein, the oxide film having a thickness corresponding to 3% of the radius of the original fibers, thereafter heated to 440° C. in a nitrogen atmosphere to make crystalline the inner portion within the oxide film and then carbonized under the same conditions as Example 17 to obtain carbon fibers. These carbon fibers had a tensile strength of 130 Kg/mm$^2$ and a Young's modulus of 12.5 t/mm$^2$.

COMPARATIVE EXAMPLE 12

The pitch fibers as obtained in Example 17 were heat treated at 290° C. for 3 minutes in the air to form an oxide film of the fibers as the surface layer therein, the oxide film having a thickness corresponding to 12% of the radius of the original fibers, thereafter heated to 450° C. in a nitrogen atmosphere to make crystalline the inner portion within said oxide film and then carbonized under the same conditions as in Example 17 to obtain carbon fibers. These carbon fibers had a tensile strength of 70 Kg/mm$^2$ and a Young's modulus of 4.0 t/mm$^2$.

As mentioned above, the present invention makes it possible to produce desirable carbon fibers easily from any kinds of pitches only by classifying the pitches into three groups in accordance with their calorific value (ΔH) and subjecting the groups respectively to specific different procedures. In addition, the present invention further makes it possible to effect spinning of pitches without breakage of the resulting pitch fibers by adding a fluorine-containing surfactant to the pitches.

What is claimed is:

1. A process for producing carbon fibers from pitches comprising the steps of:

(1) measuring pitches for their individual calorific values, ΔHs, to classify into (a) a pitch having $\Delta H < 10$ cal/g, (b) a pitch having $\Delta H = 10$ to 150 cal/g and (c) a pitch having $\Delta H > 150$ cal/g, (2) melt spinning the pitch (a) to obtain pitch fibers, partially infusibilizing the thus obtained pitch fibers at ambient temperature to 280° C. in an oxidizing atmosphere to oxidize the peripheral portion of the fibers to an extent that the thickness of the resulting oxidized peripheral portion in the form of an oxide film amounts to not larger than 5% of the radius of the original pitch fibers and then heat treating the partially infusibilized pitch fibers at 360°–450° C. in an inert atmosphere to allow the pitch fiber inner portion surrounded with said oxide film to take an optically anisotropic mesophase form thereby obtaining fixed fibers, melt spinning the pitch (b) to obtain pitch fibers, either infusibilizing the thus obtained pitch fibers at 220°-280° C. in an oxidizing atmosphere to obtain fixed fibers or partially infusibilizing the pitch fibers at ambient temperature to 280° C. in an oxidizing atmosphere to oxidize the peripheral portion of the fibers to an extent that the thickness of the resulting oxidized peripheral portion in the form of an oxide film amounts to not larger than 5% of the radius of the original pitch fibers and then heat treating the partially infusibilized pitch fibers at 360°-450° C. in an inert atmosphere to allow the pitch fiber inner portion surrounded with said oxide film to take an optically anisotropic mesophase form thereby obtaining fixed fibers, melting the pitch (c), adding a fluorine-containing surfactant to the melted pitch (c) in an amount by weight of 0.1-10% thereof and agitating the resulting mixture, melt spinning the mixture to obtain pitch fibers, either infusibilizing the thus obtained pitch fibers at 220°-280° C. in an oxidizing atmosphere to obtain fixed fibers or partially infusibilizing the pitch fibers at ambient temperature to 280° C. in an oxidizing atmosphere to oxidize the peripheral portion of the fibers to an extent that the thickness of the resulting oxidized peripheral portion in the form of an oxide film amounts to not larger than 5% of the radius of the original pitch fibers and then heat treating the partially infusibilized pitch fibers at 360°-450° C. in an inert atmosphere to allow the pitch fiber inner portion surrounded with said oxide film thereby to take an optically anisotropic mesophase form thereby obtaining fixed fibers, and (3) heat treating the fixed fibers obtained respectively from said pitches (a), (b) and (c), at 750°-1500° C. in a non-oxidizing atmosphere to obtain carbon fibers.

2. A process according to claim 1, further comprising heat treating the thus obtained carbon fibers at 2400°-3000° C.

3. A process according to claim 1, wherein at least one member selected from the pitches (a) and (b) is incorporated with a fluorine-containing surfactant in an amount by weight of 0.1-10% thereof prior to being melt spun.

4. A process according to claim 1, 2 or 3, wherein the pitch is coal tar pitch, petroleum pitch, natural asphalt, a pitch obtained by thermal depolymerization of high molecular weight compounds, or said pitch in the further heat treated state.

5. A process according to claim 1, 2 or 3, wherein the fluorine-containing surfactant is a perfluoroalkylcarboxylate, perfluoroalkylphosphate or an oligomer containing an oleophilic or hydrophilic perfluoroalkyl group.

* * * * *